United States Patent [19]

Johnson

[11] Patent Number: 5,014,859

[45] Date of Patent: May 14, 1991

[54] INTERLOCKING CARD ORGANIZER

[75] Inventor: Ron M. Johnson, Montgomery, Ala.

[73] Assignee: P.O.S. Components, Montgomery, Ala.

[21] Appl. No.: 451,573

[22] Filed: Dec. 18, 1989

[51] Int. Cl.[5] ..... A47F 7/00

[52] U.S. Cl. ..... 211/55; 211/128

[58] Field of Search ..... 211/55, 128, 50; 40/124

[56] References Cited

U.S. PATENT DOCUMENTS

| | | | |
|---|---|---|---|
| 3,173,386 | 3/1965 | Magers | 211/55 X |
| 3,198,340 | 8/1965 | Tokash | 211/55 X |
| 3,895,720 | 7/1975 | Presbery | 211/50 |
| 4,306,660 | 12/1981 | Livingston | 211/5 X |

*Primary Examiner*—Alvin C. Chin-Shue
*Assistant Examiner*—Sarah A. Lechok
*Attorney, Agent, or Firm*—Jennings, Carter, Thompson & Veal

[57] ABSTRACT

A card rack for receiving, storing and organizing cards or other articles or general planar definition including a plurality of interconnected plates supported in vertical alignment within a frame. The plates extend diagonally within the frame forming a plurality of slots. The plates are interconnected by engagement of an insertion bar formed on each plate within a receiving channel formed on each adjacent plate.

7 Claims, 4 Drawing Sheets

INTERLOCKING CARD ORGANIZER

Field of the Invention

The present invention relates to the organization and display of cards or other sheet-like material. In greater particularity, the present invention relates to apparatus for vertically positioning a plurality of cards in overlapping disposition wherein the upper portion of each card remains visible and accessible by persons searching for a particular card.

Background of the Invention

Utilization of card racks which contain vertically oriented slots have proven effective as a means for organizing cards in overlapping disposition wherein an upper portion of each card extends above the next lowest card for easy viewing. The overlapping disposition of the slots allows a large volume of cards to be stored within a minimal amount of space. Since the slots are arranged in vertical increments, one just a little higher than the other, the upper portion of each card can be provided with identification which allows the card to be seen and accessed without disturbing the other cards. Such racks are often utilized in lunchrooms and the like where children's meal tickets or cards are placed in the rack.

Prior card racks have utilized a design defined by a plurality of plates in vertical orientation to one another wherein each plate is individually connected to the rack. Typically the plates are inserted within grooves defined by the rack's frame. The plates and the frame, once connected, generally form sealed pockets in which identified cards may be placed. Such rakcs are typically constructed of a ferrous based alloy. This design proves impractical when such racks require cleaning. The sealed pockets retain water and the ferrous alloys tend to rust. Also, the construction of frames for such racks is a costly and time-consuming operation. Each frame must be machined to define the plurality of slots necessary to accommodate insertion of the plates.

Summary of the Invention

It is the principal object of this invention to provide a card organizing apparatus utilizing vertically oriented plates in overlapping diagonal orientation wherein the plates are interconnected to one another instead of connected to the frame.

In support of the principal object, another object of the invention is to provide an apparatus wherein such plates are spaced an equidistance apart by the same means utilized to interlock such plates.

Another object of the present invention is to provide a card rack which facilitates easy cleaning.

These and other objects and advantages of our invention are accomplished through the use of a plurality of slot plates including an extension element located on a rearward side of each plate and a receptacle located on the forward side of each plate wherein the extension element is located above the receptacle. The extension element of one plate is inserted and releasably secured within the receptacle of an adjacent plate. Any number of slot plates may be connected in this manner. Each slot plate is positioned parallel to every other plate and is separated from the adjacent plates by the interlocking extension elements and receptacles. The connected plurality of plates are secured by a channel frame which encompasses the marginal edges of the interconnected plurality of plates. The plurality of plates are not connected to the frame and consequently allow water to drain therethrough during cleaning of the rack. The lower part of the frame defines holes which permit water to drain from the rack.

Brief Description of the Drawings

Apparatus embodying features of the present invention are depicted in the accompanying drawings which form a portion of this disclosure and wherein.

Description of a Preferred Embodiment

Figure 1:
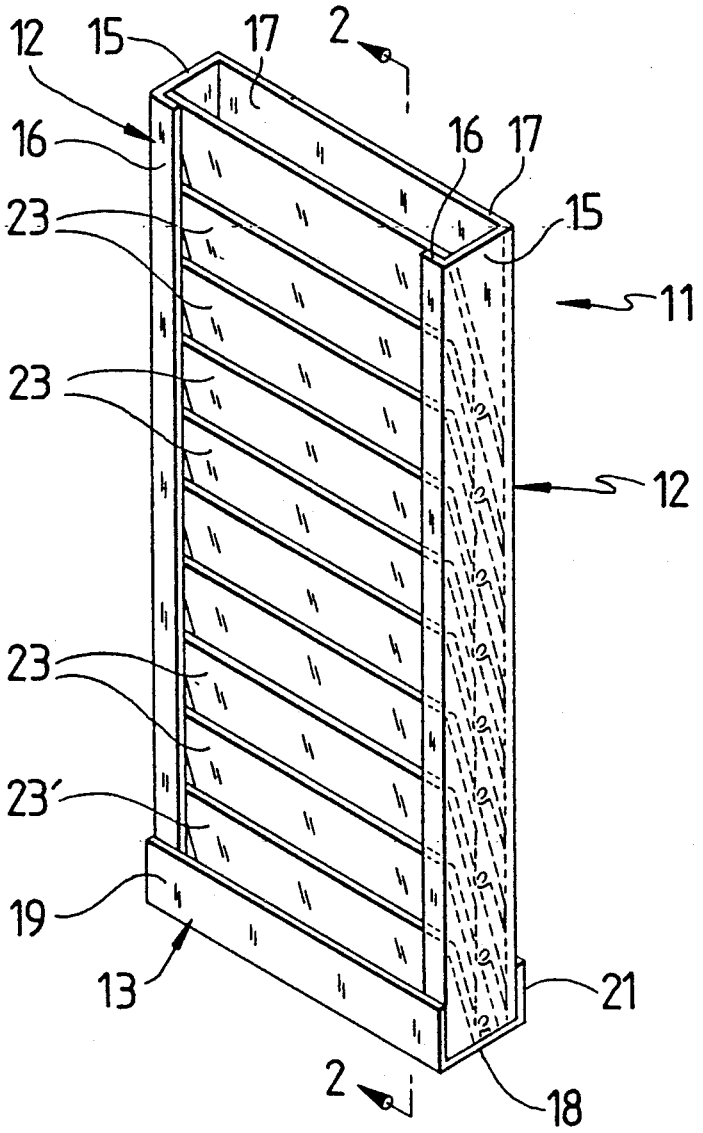
FIG. 1 is a perspective view of the first embodiment of my invention.
Figure 2:
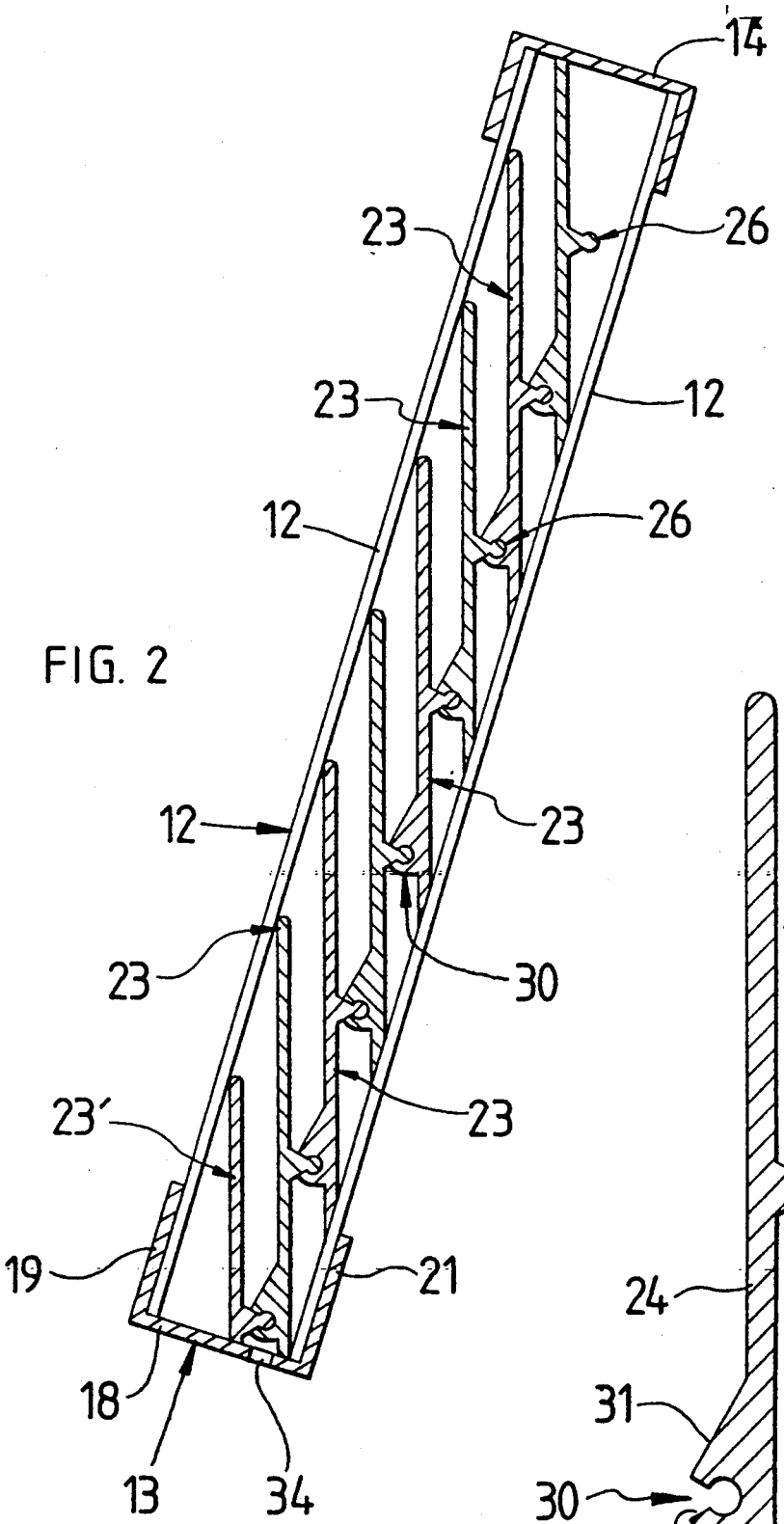
FIG. 2 is a partial sectional view taken along line 2—2 of FIG. 1.

Referring to FIGS. 1 and 2 for a clearer understanding of the invention, it should be noted that the first embodiment of the present invention contemplates the use of a frame 11 which includes a pair of vertically extending support channels 12, a laterally extending lower channel 13 which is connected to and forms a corner with the lower end of each support channel 12 and an upper channel 14 which is connected to and forms a corner with the upper end of each support channel 12. The support channels 12 are defined by a base portion 15 and two side portions 16 and 17 which extend from the marginal edges of the base portion 15 in perpendicular relation thereto. The lower channel 13 is defined by a bottom portion 18 and side walls 19 and 21.

Figure 4:
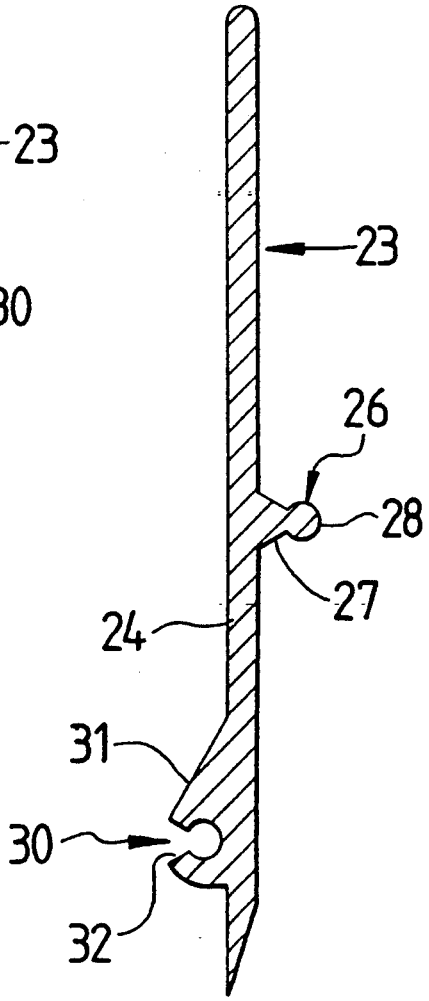
FIG. 4 is a sectional view taken along line 4—4 of FIG. 3.
Figure 3:
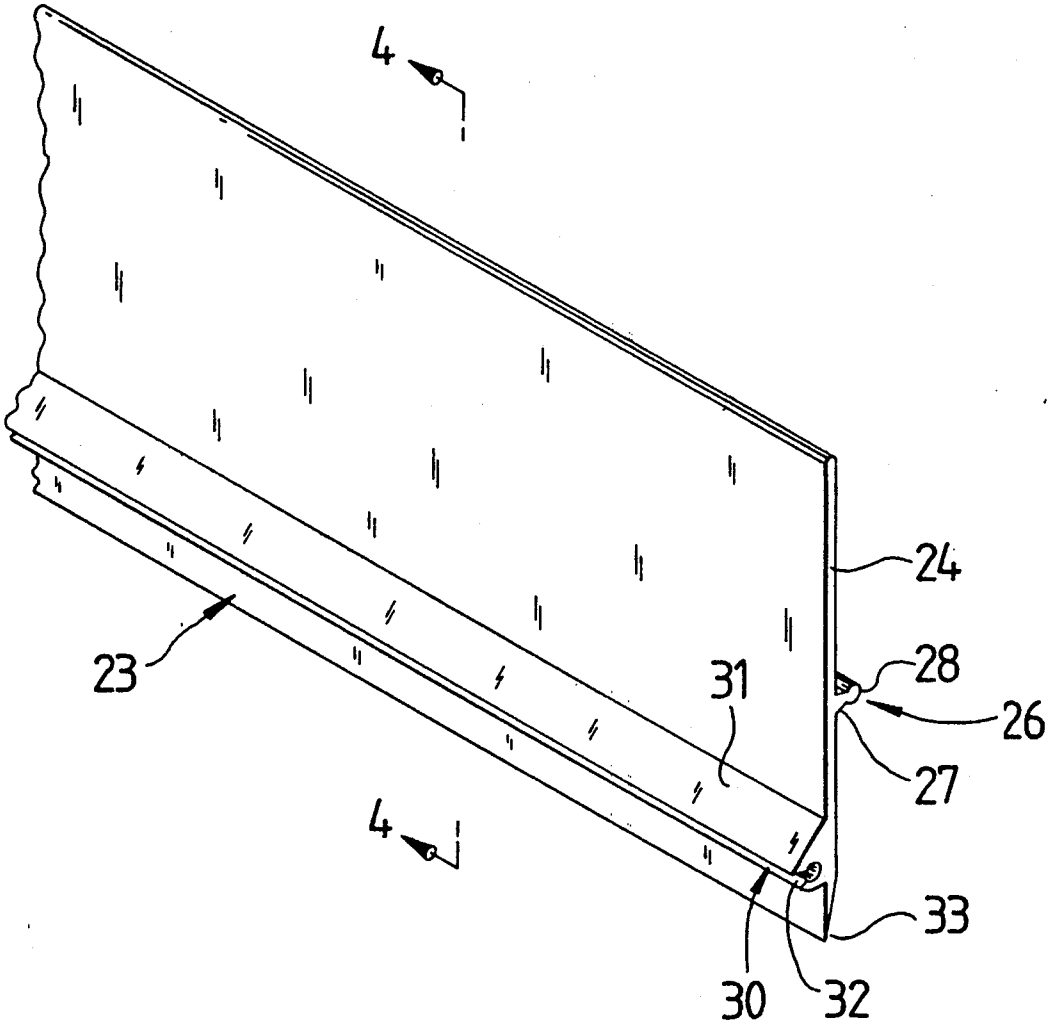
FIG. 3 is a perspective view of a slot plate.

The channels 12 and 13 encompass the marginal edges of a plurality of vertically oriented slot plates 23 and hold the slot plates in a secured linear orientation. The slot plates 23 have a generally planar body portion 24 which has integrally formed on one face thereof an insertion bar 26. As shown in FIGS. 3 and 4, the insertion bar 26 is defined by a cross-sectionally trapezoidal base 27 which extends from the slot plate 23 and terminates in a cylindrical securing portion 28 extending along the base. A receptacle 30 is formed on an enlarged protuberance 31 on the opposite face of plate 23 and includes a cylindrical securing channel 32 which extends the length of the receptacle 30 and mirrors the defining outer surfaces of the securing portion 28. The receptacle 30 has a securing slot **30*a* extending coextensively and in communication with the securing channel 32, wherein said slot 30*a* cross-sectionally mirrors the base 27 in both shape and dimension and has a pair of angularly oriented sides 30*b* to accommodate said base 27 in sliding abutment therebetween. The slot plates 23 are initially interconnected by axially inserting one end of the insertion bar 26 into an open end of the receptacle 30 until the entire insertion bar 26 is encompassed within the receptacle 30. The cylindrical portion 28 of the insertion bar has a diameter greater than the width of slot 30*a*, thus lateral movement is not possible and the base 27 of the insertion bar abuts the sides 30*b* of the slot 30*a*** to prevent rotation, thus the slot plates are secured in parallel relation to one another. As shown in FIG. 4, each insertion bar 26 is located on the slot plate 23 offset a distance above the receptacle 30. As shown in FIGS. 1 and 2, this vertical displacement of the insertion bar 26 and the receptacle 30 in combination with the parallel orientation of the plates 23, positions the plates 23 in overlapping relation to one another. The lower marginal edge 33 of each slot plate 23 is beveled to accommodate planar abutment with the side portion 17 of the support channel 12.

The apparatus is assembled by interlocking a plurality of slot plates 23 as previously described and inserting said plurality of slot plates 23 into the upper end of the support channels 12, thereby enclosing the lateral marginal edges of the plates 23 within the channels 12. The lower marginal edge 33 of the lowermost slot plate 23′ will rest in the lower channel 13, thus supporting the plurality of slot plates 23 within the frame 11. The upper channel 14 is connected to the upper end of the support channels 12 thereby securing the plates 23 within the frame 11. Any number of slot plates 23 may be interconnected to fill a predetermined height of the frame 11. The lower channel 13 defines a drainage hole 34 through which water may drain when the rack is being cleaned.

In manufacturing the present invention, the manufacturer could customize a rack for a particular customer by simply varying the height of the support channels 12. Once this length was determined then a predetermined number of pre-fabricated slot plates 23 need only be connected and inserted within the frame 11. Since the frame is constructed of common channel members, no special machining of the frame is necessary.

Figure 6:
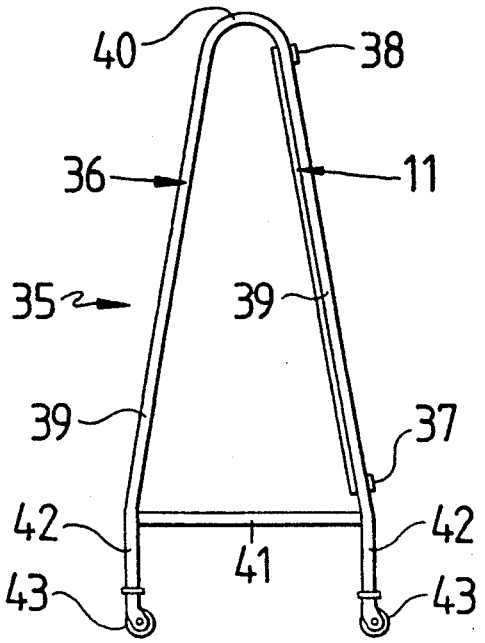
FIG. 6 is an end elevational view of the second embodiment of my invention as shown in FIG. 5.
Figure 5:
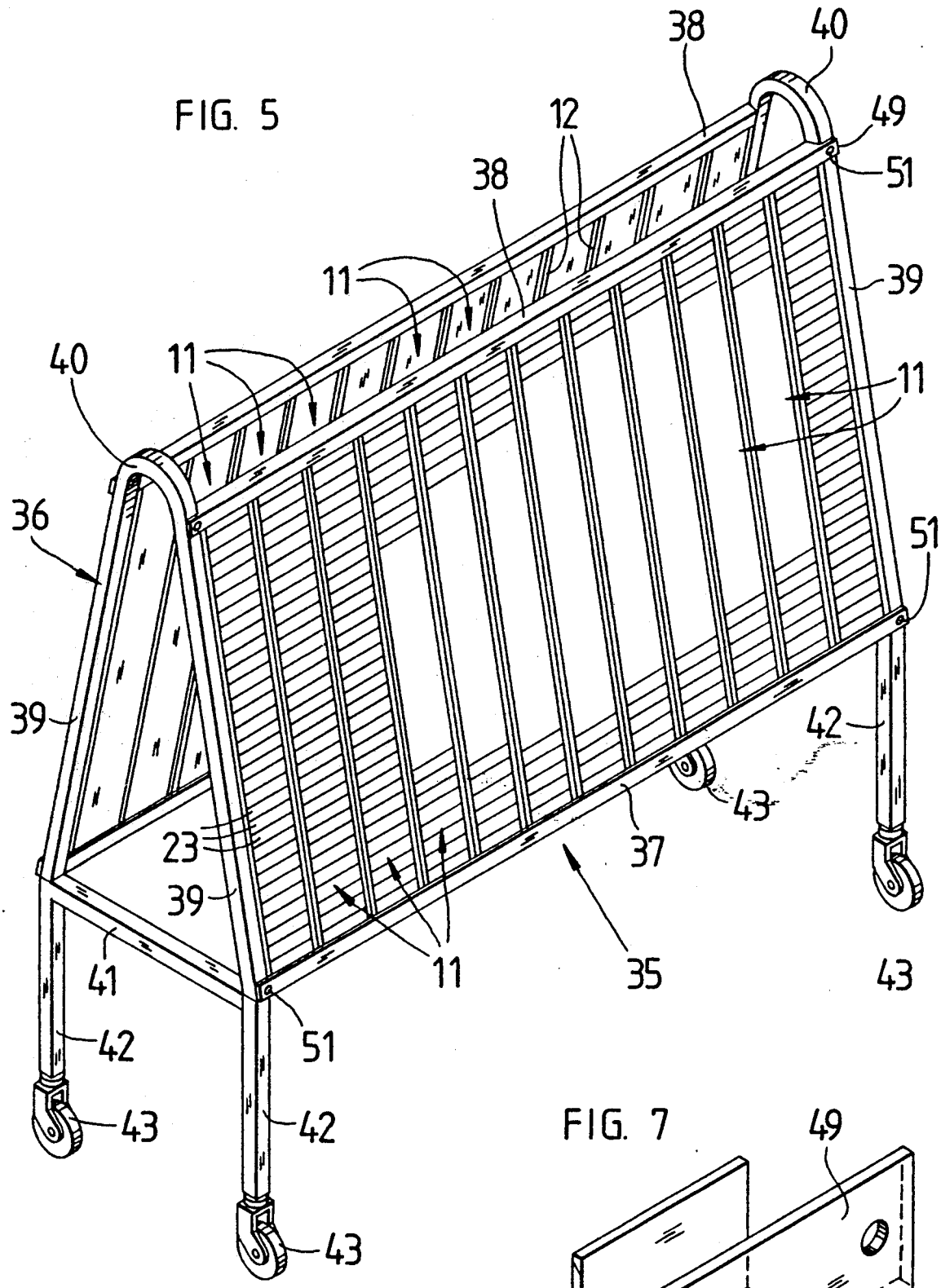
FIG. 5 is a perspective view of the second embodiment of my invention.
Figure 7:
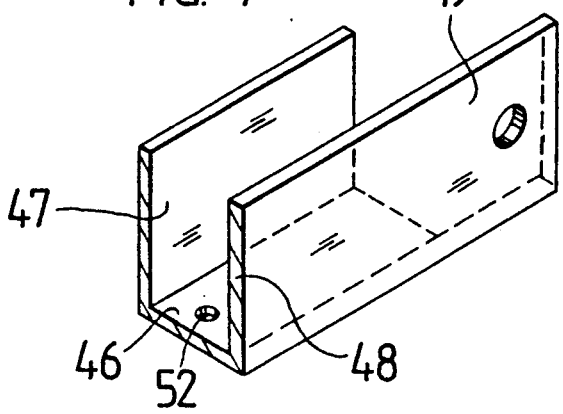
FIG. 7 is a detail perspective view of a typical support member utilized in the second embodiment of my invention.

The second embodiment of my invention encompasses all the characteristics of the first embodiment and adds the following improvements. Referring to FIGS. 5 and 6, the second embodiment contemplates the use of a plurality of pair of support channels, mounted in lateral relation on a movable carriage 35. The carriage 35 includes two inverted "V" shaped frame members 36, connected in parallel relation to one another by two upper extended channel members 37 and two lower extended channel members 38 extending transversely therebetween. The frame members 36 include two support portions 39 interconnected at their upper end by a curved portion 40 and at the lower end by a separating bar 41 extending transversely therebetween. Four legs 42 extend downward in parallel relation to one another from said carriage 34, each being connected to a lower end of said leg portion 38. Each leg 42 is supported by a wheel 43 which is pivotally mounted to the lower end of each leg 42, thereby providing mobility for the carriage 34. As seen in FIG. 7, the lower and upper extended channel members 37 and 38 serve basically the same function as the upper and lower channels 13 and 14 of the first embodiment. The plates 23 are supported by the lower extended channel member 37 in resting abutment thereon. The lower extended channel member 37 also engages the lower end of the plurality of support channels 12 which extend in perpendicular relation therefrom. Once the plates 23 are positioned within the support channels 12 the upper extended channel member is placed in encompassing engagement across the upper ends of such support members 12. As shown in FIGS. 5 & 7, each of the upper and lower extended channel members 37 and 38 include a support base 46, an inner side panel 47 and an extended outer sidepanel 48. Both the inner side panel 47 and the extended outer side panel 48 extend upwardly in perpendicular relation to said support base 46. However, the inner side panel 47 only extends the longitudinal distance of the support base 46, whereas the extended outer side panel 48 extends a predetermined longitudinal distance in both directions past the outermost extension of said support base 46, thereby defining tab portions 49. The extended channel members 37 and 38 are mounted to the support portions of the carriage 35 by bolts 51. Each lower extended channel members contains a drainage hole 52 extending therethrough.

While I have shown my invention in two forms, it will be obvious to those skilled in the art that it is not so limited but is susceptible of various changes and modifications without departing from the spirit thereof.

What I claim is:

1. Apparatus for receiving, storing and organizing articles of relatively planar definition including sheets of paper or cards, comprising a plurality of interlocking slot plates held in secured orientation by a frame, wherein each said slot plate has a rigid elongated insertion bar located on a rearward side thereof and extending horizontally thereon and a rigid elongated receptacle located on a forward side thereof extending parallel to said insertion bar a predetermined vertical distance therebelow; wherein said insertion bar includes a cross-sectionally trapezoidal base integrally connected to said rearward side of said slot plate, and a cross-sectionally circular securing portion integrally connected to an coextensive with said cross-sectionally trapezoidal base, the diameter of said securing portion being significantly wider than the most narrow portion of said trapezoidal base and; wherein said receptacle includes a cylindrical securing channel coextensively defined therein having a diameter substantially equal to the diameter of said insertion bar and a securing slot extending coextensively and communicating with said securing channel, wherein said slot cross-sectionally mirrors said base in both shape and dimension and has a pair of angularly oriented sides to accommodate said base in sliding abutment therebetween.

2. Apparatus as described in claim 1 wherein said slot plates are interlocked in vertical orientation of one another beginning with a lowermost slot plate and extending in upwardly repetitive connection to an uppermost slot plate, wherein said securing portion of said lowermost slot plate is detachably and slidably secured within said securing channel of the next highest of said plurality of slot plates with the remainder of said plurality of slot plates being interconnected and secured in similar fashion.

3. Apparatus as described in claim 1 wherein said slot plates are interconnected in parallel relation to one another.

4. Apparatus as described in claim 2 wherein said slot plates are separated an equidistance apart by said securing channels and are positioned in diagonal orientation to said frame with the lower marginal edge of each said slot plate being beveled to accommodate planar abutment with said frame.

5. Apparatus as described in claim 4 wherein said frame is mounted to a means for transporting said apparatus.

6. Apparatus as described in claim 5 wherein said transporting means comprises two "U" shaped form members interconnected in parallel relation by said frame which extends transversely therebetween.

7. Apparatus as described in claim 6 wherein said form members are defined by two leg portions displaced on their lower ends by a transversely extending separator bar connected therebetween, wherein said leg portions are supported by four wheels, each attached to a lower end of said leg portions.

* * * * *